United States Patent [19]

Dahlin

[11] Patent Number: 4,955,776

[45] Date of Patent: Sep. 11, 1990

[54] APPARATUS FOR CHARGING SOLIDS UNDER COMPRESSION INTO A RECEPTACLE

[75] Inventor: Ingemar Dahlin, Blomstermåla, Sweden

[73] Assignee: Norba AB, Sweden

[21] Appl. No.: 308,723

[22] Filed: Feb. 9, 1989

[30] Foreign Application Priority Data

Feb. 15, 1988 [SE] Sweden ..... 8800493

[51] Int. Cl.[5] ..... B65F 3/14

[52] U.S. Cl. ..... 414/525.2

[58] Field of Search ..... 100/233; 414/471, 486, 414/491, 492, 493, 525.2, 525.3

[56] References Cited

U.S. PATENT DOCUMENTS 3,462,031 8/1969 Weir ..... 414/525.2 X 4,260,316 4/1981 Gollnick ..... 414/525.2 X

*Primary Examiner*—Duane A. Reger

[57] ABSTRACT

Apparatus for charging solids under compression into a receptacle which apparatus comprises a charging unit comprising two charging and compressing plates which are driven by two driving units and guided by guides in such a manner that the charging space of the hopper has a very appropriate form.

5 Claims, 4 Drawing Sheets

APPARATUS FOR CHARGING SOLIDS UNDER COMPRESSION INTO A RECEPTACLE

The present invention relates to an improved apparatus for charging various solids under compression into a receptacle.

Apparatus of the kind concerned with the present invention comprises an apparatus for charging solids under compression into a receptacle from a hopper, which apparatus comprises a guiding means along which a charging unit is reciprocably movable, which consists of two plates being pivotably mounted around a common axis, one of the plates constituting a transport plate and the other plate constituting a press plate which is pivotable around said common pivot point between an inner and an outer position, and two driving means effecting the movement of the plates, one of said driving means being arranged to achieve said movements of the charging unit between an upper and a lower end position, said second driving means being arranged to effect an outwardly pivoting movement of the press plate when the charging unit is in its upper end position and an inwardly, towards the receptacle, directed pivoting movement of the press plate generally following the form of the bottom surface of the hopper when the charging unit is in its lower end position, beside which an upper end of the transport plate is guided by said guiding means and the press plate is guided by the guiding means via a lever arm. This is the case with U.S. Pat. No. 4,551,055.

The movements of the plates disclosed by the above document, are achieved by means of hydraulic jacks, where one of the jacks is attached between the two plates in order to cause pivoting movements mainly of the lowermost of the plates, whereas the other jack has one of its end parts attached to a part of the hopper, and its other end attached to an attachment point creating the pivoting center of the lowermost plate. This pivoting center is, in accordance with this prior known solution, a common attachment point for both of the jacks and is situated on a lever arm, which arm is arranged opposite the effective part of the lowermost plate. Since the pivoting center is not, constituted by the common joint, the lower most plate has to be dimensioned in relation thereto and therefore has a large pivoting radius, which means that the charging pocket of the hopper has to be unfavorably shallow, at the same time as the pivoting range of the press plate has to be relatively, restricted, so that the dimensions of the hopper are not going too be to large in relation to the other dimensions of the apparatus. Furthermore a large press plate requires more force than a small press plate in order to achieve the same surface pressure.

The object of the present invention is to solve the above problems and to provide an apparatus, by which a large charging space of the hopper is achieved in relation to the outer dimensions of the apparatus, a pre-compression of the refuse between a transport plate, which is a part of the charging unit, and an angled wall within the hopper and thereby an extreme compression of the solids is achieved during the charging of the material into the receptacle.

In the apparatus according to the invention, the first driving means is attached to an upper end of the transport plate partly in order to achieve the reciprocal movement of the charging unit and partly in order to secure the upper end of the transport plate against a movement along the guiding means during a substantial part of the pivoting movement of the press plate, the transport plate being, when in its lower end position, caused to perform a pivoting movement around a pivoting center, mainly without movement of the latter, in a direction towards a wall part of the hopper for the purpose of a first compression of the solids against the wall part, and wherein the second driving means is arranged effect the inwardly directed pivoting movement of the press plate by means of a downwardly directed movement along the guiding means of the lever arm in order to cause the pivoting movement of the press plate about the common axis.

In the following a preferred mode of example of the invention will be explained more in detail with reference to the annexed drawings, in which FIG. 1 shows a side view of the apparatus in accordance with the invention, placed in a hopper, from which one of the side walls is removed in order to improve the clarity, FIG. 2 is a view from behind of the apparatus in accordance with the invention, FIG. 3 shows the device in a starting position, in which a charging unit of the device is situated in an upper end position, FIG. 4 shows an intermediate position of the pivoting motion of a press plate in a counter-clockwise direction.

Figure 1:
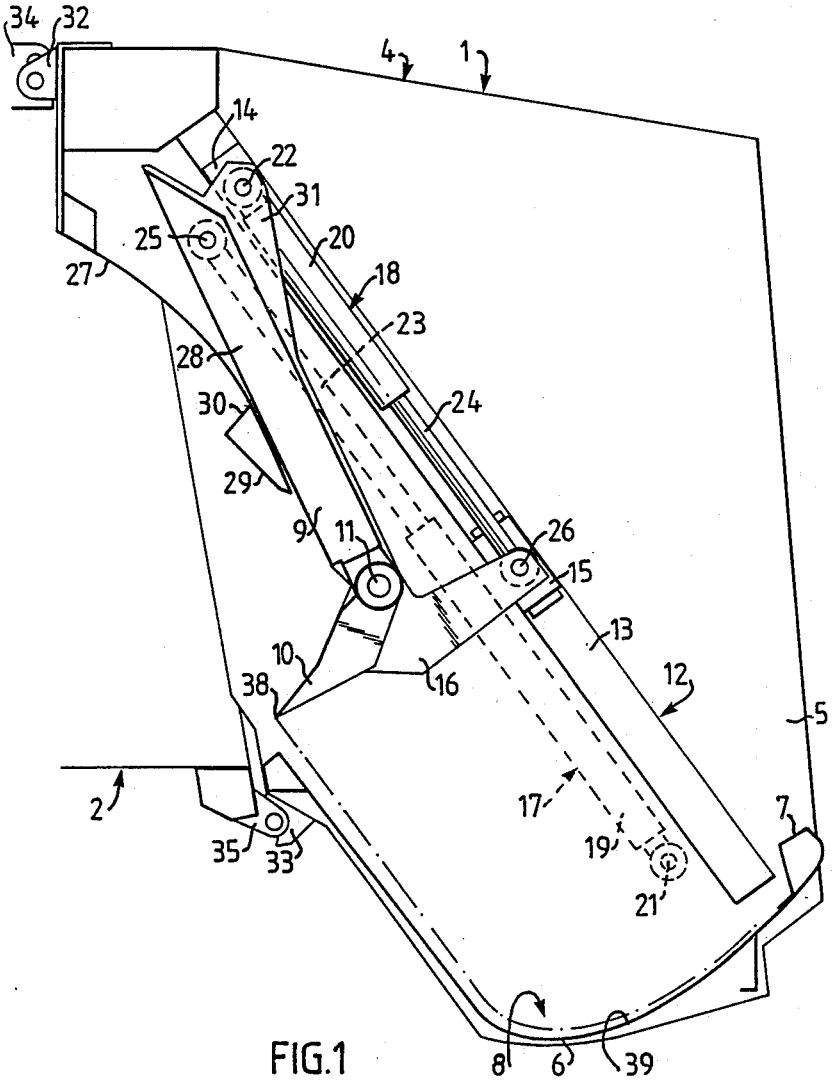
Figure 2:
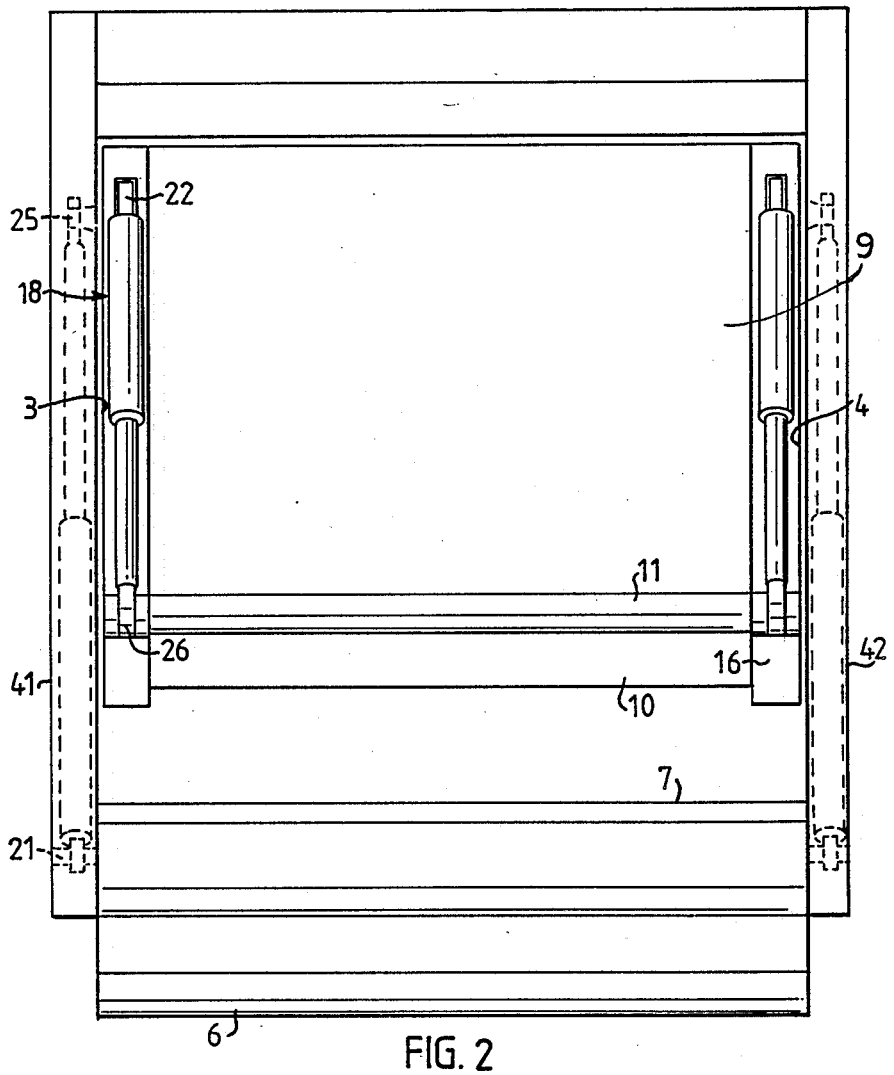

As is best shown in FIGS. 1 and 2, the charging device is placed in a hopper 1 to a receptacle 2 intended to receive compressible material, e.g. refuse. The receptacle 2 can be a mobile refuse container, placed on a vehicle, intended for collecting refuse. Alternatively, the receptacle 2 can be a stationary container at a collection station for refuse. The hopper 1 can be a detachable unit mounted at the back of the receptacle, said hopper comprising two side walls 3, 4, one of which has been removed to improve the clearness of FIG. 1 so that the charging device is fully visible from the side. The hopper 1 is open at the back having, in the shown example, a mainly rectangular opening 5. The bottom part 6 of the hopper is formed to a pocket having a partly curved form. The opening 5 is at its lower part limited by a generally horizontal charging edge 7. By means of the above described form of the hopper a pocket-like charging space 8 is achieved in which the refuse, e.g. garbage bags, can be put by charging through the opening 5. The hopper 1 can be totally open at the top or be protected by means of a cover plate or a similar means.

The charging device in accordance with the invention comprises a movable charging unit which consists of a transport plate 9 and a press plate 10. The transport plate 9 and the press plate 10 are movably interrelated with each other by means of a joint 11. As is best shown in FIG. 2 the transport plate 9 and the press plate 10 substantially co-extend with the charging opening 5 and are intended to mainly shut the receptacle 2 which on the other hand is open towards the charging pocket 8.

The charging device further comprises a guiding means 12, which practically is subdivided into two guides, each of which is placed adjacent one side plate 3, 4, of the hopper, e.g. in the form of a groove- or channel-like means 13 arranged at each side plate. In the shown example the guides are straight, which results in a linear movement for those parts which are guided by the guide means. The transport plate 9 is in connection with its upper end provided with a guideable means 14, which is interrelated with the guiding means 12, and is movably controlled by the groove 13 of the guiding means so that the upper end of the transport plate 9 is guided by the groove during the removal along it in a way as will be described more in detail below. In a corresponding manner the press plate 10 is guided along the guiding means 12 by being provided with a guideable means 15, which is interrelated with the guiding means 12 and is arranged on a lever arm 16 and is thereby distanced from the joint 11.

The movements of the charging device are effected by means of driving units, more precisely a first driving means 17, which is connected to the transport plate 9 for movement of the charging unit, i.e. for movement of the transport plate 9 and the press plate 10, between an upper and a lower level, and a second driving means 18 which is arranged between the transport plate 9 and the press plate 10 in order to effect the pivoting movement of the press plate 10 around its pivoting axis which is the joint 11. The driving units 17, 18 constitute linear engines in the form of units, which are able to expand having two attachment points. The first driving unit 17 effects a linear movement of the charging unit along the guiding means 12, whereas the other driving unit 18 effects a pivoting movement of the transport plate 9 and the press plate 10, since the press plate 10 is pivotably arranged about its pivoting axis 11 and driving unit 18 is attached thereto at a distance from the pivoting axis 11 so that a lever arm is created which is constituted by the lever arm 16. The driving units 17, 18 are preferably constituted by hydraulic jacks having a cylinder 19, 20 which is pivotably attached to an attachment point 21, 22 and a rod 23, 24, which is pivotably attached to another attachment point 25, 26. The attachment points 22, 26 are situated in the groove 13 and are guided thereby so that they follow its extension.

The closing of the refuse receptacle 2 by means of the charging device is supplemented by means of a partition 27, which in the shown example is constituted by a resilient plate, which is attached to the hopper 1. The plate has such a length and is so adapted that it resiliently contacts the inner surface 28 of the transport plate 9 even during the pivoting and longitudinal movements thereof so that a continuous closing of the receptacle is provided for with exception for the charging opening, which is created at the lower end at certain moments of the charging process, which will be described more in detail below. The partition 27 is at its lower end is provided with a triangular like part 29 creating an upwardly directed part 30, which constitutes a support for the refuse in the upper rear parts of the receptacle during the charging thereby preventing the refuse to fall back while charging.

From FIG. 2 it can be seen that the first as well as the second driving unit 17, 18 each constitutes two jacks, as a consequence of the width of the device. This ensures good power symmetry and a practical design. Each of the jacks 17, of the first driving unit, is arranged within in a boxlike beam 41, 42 extending in an inclined manner upwards along a respective side plate 3, 4. This box-like beam could also comprise the groove 13 of the guiding means 12. The jacks of the upper driving unit 18 are arranged on each side of the transport plate 9 and the press plate 10.

One of the attachment points 21 for the first driving unit 17 constitutes a fixed attachment point in the hopper, e.g. in the form of a transversal axis, onto which the jack is pivotably arranged. The opposite attachment point 25 constitutes, in relation to the hopper, a movable attachment point, and does also constitute a pivoting joint, which makes a pivoting movement of the transport plate 9 relatively to the rod 23 of the driving unit 17 possible. The other two jacks 20 which constitute the second driving unit 18 are attached so that the attachment points 22, 26 are placed each one in a guidable means 14, 15, of which in the shown example there are four. The attachement points 22, 26 for the second driving unit 18 are guided in order to only produce a linear movement within the track defined by the guiding means 12. In the shown example the upper attachment point 22 is not directly mounted to the transport plate 9 but is mounted a distance above this by means of two support arms 31, whereas the upper attachment point 25 for the first driving unit 17 is arranged in the transport plate and accordingly distanced from the attachment point 22 for the second driving unit. The attachment point 25 constitutes a pivoting axis for the transport plate 9, about which the transport plate can pivot, as will be described more in detail below. The lower attachment point 26 for the second driving unit 18 is arranged at the lever arm 16, by means of which the press plate 10 is pivoted about its pivoting axis 11. The lever arm 16 constitutes more precisely two lever arms placed at each side of the press plate 10.

The hopper 1 is detachably mounted at the rear end of the receptacle 2, e.g. by means of flanges 32, 33, which by means of screws and nuts are attached to the corresponding flanges 34, 35 of the refuse receptacle.

Figure 3:
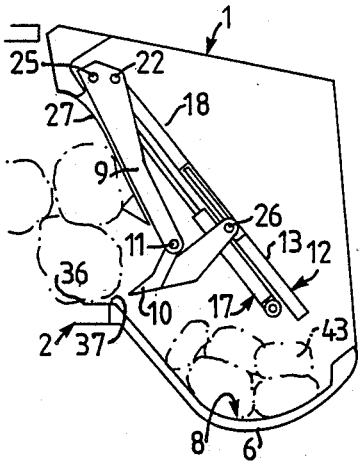

The function of the combined charging and compressing device in accordance with the invention will be more in detail described with reference to the schematic drawings, FIGS. 3–10, which show different positions of the device during the working cycle. FIG. 3 shows the device in a starting position in which the charging unit is situated in an upper end position with the press plate directed inwardly against the bottom 36 of the receptacle and more precisely against that edge 37, which is created by the transition area between the bottom 36 of the receptacle and the bottom part 6 of the hopper. In this position the charging device mainly creates a closure of the rear of the receptacle 2, since the transport plate 9 and the press plate 10 together with the partion 27 form a continuous unit. In this starting position the jack 17 is in its most expanded position, so that the charging unit 9, 10, which is movable along the guiding means 12, has its upper guidable means 14 substantially in the upper end of the groove 13. Also the jack 18 is in its most expanded position thereby creating a maximum distance between the attachment points 22, 26 of the jack. In a corresponding manner the attachment points 21, 25 for the jack 17 are kept at a maximum distance. This starting position can constitute a stationary position when the charging and compressing device is not in operation, e.g. during loading of refuse material 43 into the pocket-like space 8 or during transport, if the receptacle 2 and the hopper 1 are arranged on a vehicle. Since the charging device effects a closure of the receptacle the charged material within the receptacle will be kept back. When the charging device is in operation the position shown in FIG. 3 only is one of the positions, which together create a whole working cycle of the charging device.

Figure 4:
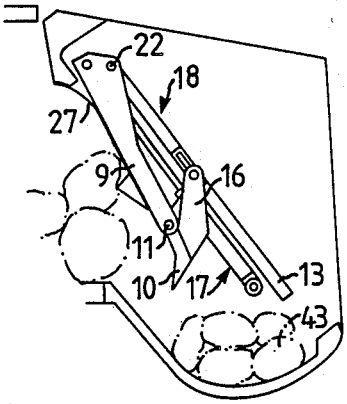

FIG. 4 shows an intermediate position during pivoting of the press plate in a counterclockwise direction, which is effected by the contraction of the jack 18, which makes the lever arm pivot upwards. Hereby a pivoting of the press plate 10 about the pivoting axis 11 is effected. The charging unit is still situated in its upper end position, accordingly still with the jack 17 in its most expanded position. Since both of the attachment points 22, 26 of the jack 18, are guided by the groove 13 of the guiding means 12, in order to only make linear movements, a movement of the pivot axis 11 of the press plate 10 in direction towards the groove 13 takes place and therefore also a pivoting movement of transport plate 9 about the upper attachment point 25 of the jack 17. As a consequence thereof an insignificant movement of the upper attachment point 22 of the jack 18 and the guidable means 14 take place. By means of its resiliency the partition 27 does follow this pivotal movement and does mainly during the whole working cycle contact the inner surface of the transport plate.

Figure 5:
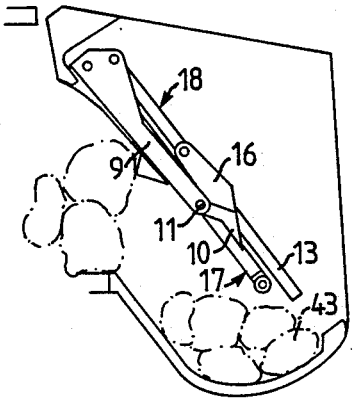
FIG. 5 shows an end position of the outswinging motion of the press plate.
Figure 6:
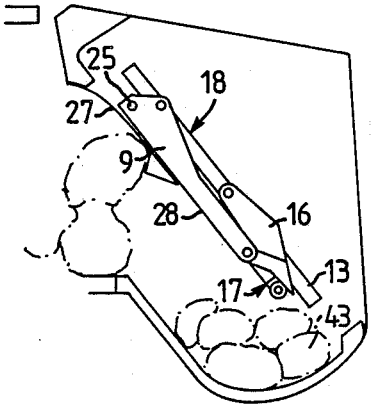
FIG. 6 shows an intermediate position of a lowering movement of the charging unit.

In FIG. 5 the end position of the outswinging motion of the press plate 10 is shown, in which position both the press plate 10 as well as the transport plate 9 are directed mainly co-extensively with the groove 13.

In conjunction with the termination of the outswinging motion of the press plate 10 in accordance with FIG. 5 the charging unit 9, 10 is effected to be lowered by a movement following the guiding device 12 and more precisely in a direction towards the bottom plate 6 of the hopper, towards the outer part thereof. This lowering movement is shown in an intermediate position in FIG. 6 and is achieved by the contraction of the jack 17, which applies a downwardly directed force onto the upper attachment point 25, directed along the extension of the groove 13. During this lowering motion the inner surface of the transport plate 9 is allowed to slide against the outer side of the partition 27.

Figure 7:
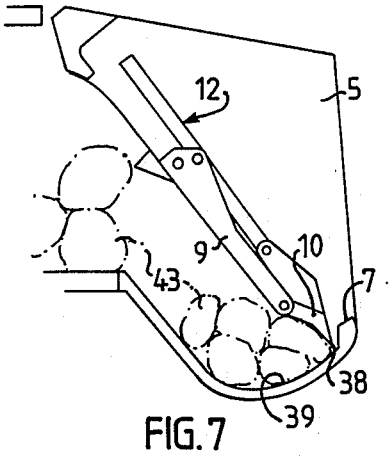
FIG. 7 shows a lower end position of the charging movement.
Figure 8:
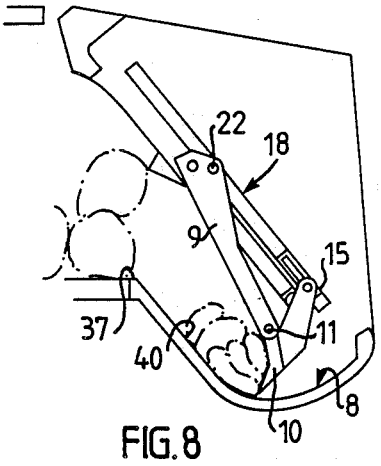
FIG. 8 shows a pivoting movement of the press plate constituting a pre-compression movement.

FIG. 7 shows the lower end position of the charging unit 9, 10 in which position the front edge 38 of the press plate 10 is situated insignificantly distanced from the concavely rounded wall part 39 of the charging space 8, more precisely adjacent the outer end of the latter, somewhat inside the edge 7 of the charging opening.

When the linear downwardly directed movement, along the direction of the guiding means 12, has reached its lower end position, the charging device is activated to perform that part of the working cycle which constitutes the real charging and compression movement. This is effected by a clock-wise pivoting movement of the lever arm 16 of the press plate 10, whereby the press plate is pivoted clock-wise about its pivoting axis 11. This is effected by the expansion of the jack 18 whereby the guidable means 15, which is attached at a lower attachment point 26 of the jack, is moved in a linear way along the groove 13 causing the pivoting axis 11 to perform a movement in a direction away from the groove 13, more precisely a circle shaped movement about the axis 22 of the transport plate. Accordingly also the transport plate performs a corresponding pivoting movement about its pivoting center which also when the charging unit is in its lower most position is constituted by the upper attachment point 25 of the jack 17.

As is evident from the Figs. the charging space 8 of the hopper presents a special form having said bow-shaped curved concave wall part 39 which radius successively diminishes in a direction towards the bottom of the charging space 8 and thereafter merges into a mainly plane wall part 40 which extends up to the transition edge 37. This form of the charging space is strongly related to the pivoting movement of the press plate 10, mainly comprising a pivoting movement of the press plate 10 about its pivoting axis during a simultaneous, small movement of the pivoting axis 11 in accordance with the above. The pivoting movement of the press plate 10 in a first part of the pivoting movement sweeps over a major part of said charging space 8 with its front edge part 38 and at the same time a pivoting movement of the transport plate 9 in direction towards the plane part 40 of the charging space 8 takes place, which provides a substantial pre-compression of the refuse, during the pivoting movement within this first part, which mainly is a movement from the position shown in FIG. 7 in a direction towards the plane part 40 to a position shown in FIG. 8. This pre-compressing is highly effective since a major part of the refuse is crushed against the plane wall part 40. A pre-compression is also taking place due to the direct activity of the press plate, since the refuse closest to the press plate 10 is hindered by the refuse being squeezed between the transport plate 9 and said wall part 40.

Figure 9:
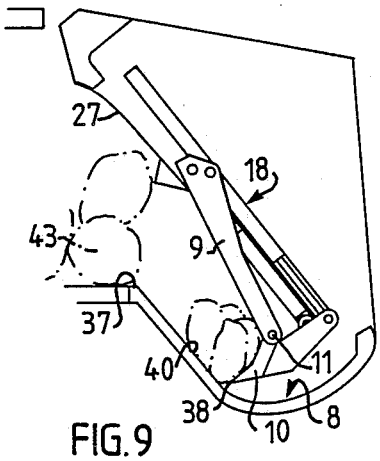
FIG. 9 shows a raising movement of the charging unit for compression and charging purposes.

The latter described movement reaches its completion when it reaches the position as shown in FIG. 9 in which position the transport plate 9 is even more pivoted in a direction towards the wall part 40. At this stage, however, the movement of the pivoting axis 11 in a direction towards the wall part 40 is retarded, causing a diminishing radius for the pivoting movement of the edge part 38 which makes it generally correspond to the distance between the pivoting axis 11 and said edge 38 so that the edge part 38 generally follows the form of the bottom of the charging space 8 at an insignificantly distance therefrom. The pivoting movement of the press plate 10 is terminated when it reaches the position according to FIG. 9, in which the jack 18 terminates its expansion and is kept in its most extended position.

During the whole above described pivoting movement of the press plate 10 the refuse 43 that is put on the bottom of the charging space 8 is brought along, since the edge part 38 is moving closely to the bottom of the charging space and since the press plate together with the transport plate 9 and also the partition 27 forms a closed wall.

When the press plate 10 reaches its terminal position as shown in FIG. 9 the jack 17 is activated for the linear movement of the charging unit, i.e. a movement of the press plate and the transport plate upwardly directed along the guiding means 12 during which movement the press plate 10 is kept at its inwardly swung position, generally perpendicular to the extension of the transport plate 9. Thereby the refuse is lifted in an upwardly inclined direction into the refuse receptacle 2 being compressed against the refuse within the receptacle. In the shown example the angle of inclination of the plane part 40 of the charging space 8 is chosen so as to be slightly bigger than the angle of inclination of the extension of the guiding means 12 which guides the upwardly inclined movement of the press plate 10. As a consequence, the distance between the edge part 38 of the press plate 10 and the plane part 40 of the charging space 8 increases during the upwardly directed movement of the press plate 10, which has proved to facilitate the movement of the refuse over the transition edge 37. The movement of the edge part 38 is indicated in FIG. 1 by a dash and dotted line. The jack 18 is arranged in such a manner that if the resistance from the refuse exceeds a certain value the press plate 10 tends to yield which would make it pivot outwardly during the lifting movement. This function reduces the risk of damages due to overloading of the mechanics and hydraulics comprised in the device.

Figure 10:
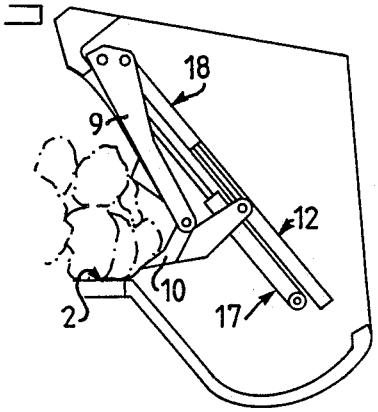
FIG. 10 shows the terminal position of the working cycle.

A working cycle is terminated and the combined charging and compression device has reached its terminal position at the position shown in FIG. 10, which corresponds to the starting position shown in FIG. 3.

Accordingly a very efficient pre-compression of the refuse is achieved by the device, which results in an increase of the charging capacity of the receiving receptacle. Thanks to the above described movement of the device, is it possible to have a press plate 10 which is comparatively shorter than those used for prior art devices, which results in a higher effective surface pressure against the refuse and leads to an increased compression. Furthermore the form of the charging space 8, in relation to the total dimensions of the hopper, can be formed in a more appropriate way having a large depth which increases the charging capacity although the dimensions of the press plate are relatively small.

The invention is not restricted to the above described nor to the mode of examples showed in the drawings, but can be varied within the scope of the claims. It is for example possible that the guiding means 12 has a non-linear extension so that the lifting and lowering movement of the charging device would be curved. Further it is possible that said partition 27 is exchanged for a wall which is hingedly connected between the upper part of the hopper and the transport plate 9. In theory it is also possible to exclude the partition 27 and to replace this by some other means, e.g. and upwardly directed extension of the transport plate 9. In principal it is possible that the driving means could be of any other kind than hydraulic, e.g. pneumatic or electric. Moreover it is possible to use one single jack instead of the double system, which is used for the driving means. As a reason of simplicity there has only been made references to one detail in relation to the FIG. 3 to 10, e.g. a groove 13, the jack 17, 18, the lever arm 16, etc, although all these parts are doubled as has been shown and described with reference to FIG. 2.

I claim:

1. Apparatus for charging solids under compression into a receptacle from a hopper, comprising a guiding means, a charging unit reciprocally movable along said guiding means, said charging unit comprising two plates pivotably mounted around a common axis, one of said plates constituting a transport plate and the other plate constituting a press plate which is pivotable around said common axis between an inner and an outer position, first driving means for moving said charging unit between an upper and a lower end position, second driving means for moving said charging unit whereby said press plate is movable by said second driving means in an outwardly pivoting movement when the charging unit is in its upper end position and in an inwardly pivoting movement towards the receptacle and generally following the form of a bottom surface of the hopper when the charging unit is in its lower end position, an upper end of said transport plate being guided by said guiding means, and said press plate being also guided by said guiding means by means of a lever arm, and wherein said first driving means is attached to an upper end of said transport plate in order to achieve said reciprocal movement of the charging unit and to secure said upper end of the transport plate against a movement along said guiding means during a substantial part of the pivoting movement of the press plate, said transport plate, when in its lower position, being pivotably movable around a pivoting center, mainly without movement of the latter, in a direction towards a wall part of the hopper for performing a first compression of solids against said wall part, and wherein said second driving means is operable to effect said inwardly pivoting movement of said press plate by means of a downwardly directed movement along said guiding means of said lever arm to cause said pivoting movement of the press plate about said common axis, said lever arm being guided by the guiding means by means of guidable means which is movable along the guiding means during the pivoting movement of the press plate, whereby the pivoting point of the press plate is caused to move in a direction towards and away from the guiding means respectively.

2. Apparatus according to claim 1, wherein said guiding means extends generally rectilinearly and is inclined in relation to the vertical axis.

3. Apparatus according to claim 1, wherein said first driving means comprises at least one jack having an upper attachment point at the upper end of the transport plate, and a lower attachment point at a fixed part of the hopper.

4. Apparatus according to claim 2, wherein said bottom part of the hopper has a curved concave from whose curvature successively increases towards the bottom and thereafter decreases in a direction towards the receptacle where it merges to constitute said wall part which substantially has the same inclination as the guiding means.

5. Apparatus according to claim 4, wherein said wall part has a larger inclination in relation to the vertical axis than said guiding means, whereby the distance between said wall part and said press plate increases during said reciprocal movement of said press plate in a direction from said lower end position towards said upper end position.

* * * * *